United States Patent [19]

Kamiwaki

[11] 4,274,151

[45] Jun. 16, 1981

[54] ELECTRONIC WATCH HAVING AN ALARM FUNCTION AND A GLOBAL TIME DISPLAY FUNCTION

[75] Inventor: Osamu Kamiwaki, Suwa, Japan

[73] Assignee: Kabushiki Kaisha Suwa Seikosha, Tokyo, Japan

[21] Appl. No.: 99,689

[22] Filed: Dec. 3, 1979

[30] Foreign Application Priority Data

Dec. 4, 1978 [JP] Japan ..... 53-150181

[51] Int. Cl.[3] ..... G04B 19/22; G04B 23/02

[52] U.S. Cl. ..... 368/21; 368/74

[58] Field of Search ..... 368/12, 21, 22, 72, 368/73, 246, 261, 74, 250, 251; 364/705

[56] References Cited

U.S. PATENT DOCUMENTS

| | | | |
|---|---|---|---|
| 3,955,355 | 5/1976 | Luce | 364/705 |
| 4,180,969 | 1/1980 | Naito | 368/21 |
| 4,183,203 | 1/1980 | Maezawa et al. | 368/21 |

*Primary Examiner*—Vit W. Miska

*Attorney, Agent, or Firm*—Blum, Kaplan, Friedman, Silberman and Beran

[57] ABSTRACT

An electronic watch which normally displays home time and calendar data, on demand displays additional data and correct time and calendar data for every global time zone in response to actuation of external members. An alarm function is set by actuation of external members in either the home or global mode. When the alarm is set in the home mode, the alarm sounds at the same display-indicated time regardless of the time zone of operation. When the alarm is set in the global mode, the alarm sounds at the selected hour in a particular time zone regardless of the time in the actual zone of operation. The display returns to the home time display mode if the external members are continuously actuated for a time in excess of a predetermined period. Data derived from a signal generator and divider network is inputted to counters accumulating timekeeping and calendar data. An alarm-setting counter holds alarm data selected by the user. Changing time zones for display by actuation of external members adds or subtracts incremental counts to the counters.

12 Claims, 3 Drawing Figures

ELECTRONIC WATCH HAVING AN ALARM FUNCTION AND A GLOBAL TIME DISPLAY FUNCTION

BACKGROUND OF THE INVENTION

This invention relates generally to an electronic watch having a digital display and more particularly to an electronic watch which on demand displays the time in any selected time zone and includes an alarm function which is triggered either by home time or global time in any selected zone. In electronic watches of the prior art which include both a global time display function and an alarm function in combination, it has been common to emit the alarm sound when the time in the particular zone being displayed and the set time for the alarm coincide with each other. The alarm function is unrelated to any time other than that which is displayed. As a result, maximum effectiveness is not achieved in using the functions available in the timepiece.

What is needed is an electronic watch wherein the alarm can be triggered by either a selected time in the time zone of operation or at a selected time in a time zone other than the time zone of operation.

SUMMARY OF THE INVENTION

Generally speaking, in accordance with the invention, an electronic watch especially suitable for home time and global time functions, with alarm functions coordinated to either home or global time, is provided. The electronic watch, which normally displays home time and calender data, will on demand display additional data and correct time and calender data for every global time zone in response to actuation of external members. An alarm function is set by actuation of external members in either the home or global mode. When the alarm is set in the home mode, the alarm sounds at the same display-indicated time regardless of the time zone of operation. When the alarm is set in the global mode, the alarm sounds at the selected hour in a particular time zone regardless of the time in the actual zone of operation. The display returns to the home time display mode if the external members are continuously actuated for a time in excess of a predetermined period. The alarm setting can be brought to display on demand, as can Greenwich mean time and calendar data.

Accordingly, it is an object of this invention to provide an improved electronic watch having both home time and global time display functions.

Another object of this invention is to provide an improved electronic watch wherein on demand the present time in any time zone can be displayed.

A further object of this invention is to provide an improved electronic watch including an alarm function and capable on demand of displaying the alarm-set time.

Still another object of this invention is to provide an improved electronic watch wherein the alarm is actuated at a selected time in a particular time zone regardless of the actual time zone wherein said watch is being used.

Yet another object of this invention is to provide an improved electronic watch having an alarm function wherein said alarm function is triggered at the same time of day regardless of the time zone in which the watch is operating.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DESCRIPTION OF THE PREFERRED EMBODIMENTS

This invention relates to an electronic watch having a global time display function and an alarm function. The developments in the field of electronic timepieces and watches which have accompanied the development of large-scale integrated circuits and the like are remarkable. Tremendous progress is rapidly being made in the field of complete electronic watches providing multi-functions including a chronographic function, an alarm function, global time display functions, counter functions and the like. There are some prior art electronic watches where such functions are unintegrated but are merely combinations of separate functions. Such watches are not easy to use.

The electronic watch according to this invention eliminates the above-mentioned complications and provides a multi-functional watch which combines the additional functions in an integrated combination and is easy to use.

In the watch of the prior art having a global time display function and an alarm function, it has been common to emit the alarm sound when the time in the displayed time zone and the alarm-set time coincide with each other. The alarm is unrelated to the time in other time zones, and effective utilization of the functions available within the watch is not accomplished. The watch of this invention inherently combines a global time display function and an alarm function to provide a watch which is easy to use and provides substantially instantaneous availability of both home time data and alarm function and global time data and alarm function.

Figure 1:
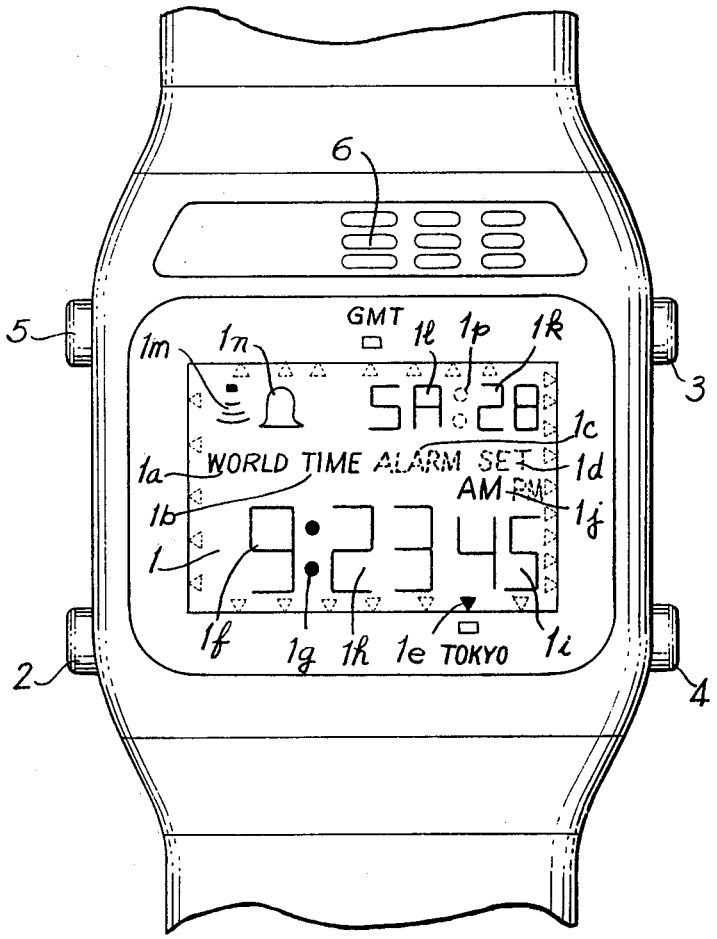
FIG. 1 is a front view of an electronic watch in accordance with this invention.

FIG. 1 is a front view of a watch in accordance with this invention. As the internal structure of this watch is well known, a detailed explanation is omitted. In FIG. 1, the liquid crystal panel 1 of a watch is in the display state of a global time mode. Marks 1*a*, 1*b*, 1*c* and 1*d* on the panel 1 indicate the state of the watch. As explained more fully hereinafter, these marks are illuminated, not illuminated or independently flickering. Display states can be distinguished on observation by noting different combinations of marks being illuminated. Marks 1*e* indicate time zones. There are as many marks 1*e* as there are time zones around the globe. One of the marks for indicating a time zone is illuminated so as to show in what time zone the time is now displayed on the panel 1. Display elements 1*f* illuminate numerals from zero to 99 and indicate hours in different display modes. FIG. 1 shows a global time display mode. A colon 1*g* separates the hour mark 1*f* from the minutes. In the same way as the hour mark 1*f*, marks 1*h*, 1*i* and 1*k* indicate minutes, seconds and date, respectively. Mark 1*j* indicates AM or PM. Elements 1*l* display numerals and letters of the alphabet, the letters forming an abbreviation of the day of the week in the time display modes. Mark 1*m* indicates whether an alarm in the watch is set or not set, and mark 1*n* indicates whether the watch is in a state where a time signal sound is emitted or not emitted at the selected alarm time. Mark 1*p* is another colon, separating the day markings 1*l* and the date markings 1*k*. The watch as illustrated in FIG. 1 displays 23 minutes and 45 seconds of the ninth hour in the morning (AM), Saturday, the 28th day of the month in Tokyo. The month and the year are not present in this display mode. The alarm and the time signal sounding device are set. Please note that solid lines indicate illuminated marks, and dotted lines indicate marks which are not illuminated in FIG. 1.

External operation buttons 2, 3, 4 and 5 extend from the watchcase in the usual manner for changing the display modes. Buttons 3 and 4 are for operations within the modes as explained more fully hereinafter. Button 5 is operating a light to illuminate the panel 1, and a portion 6 is provided on the face of the timepiece for emitting the alarm sound.

Figure 2:
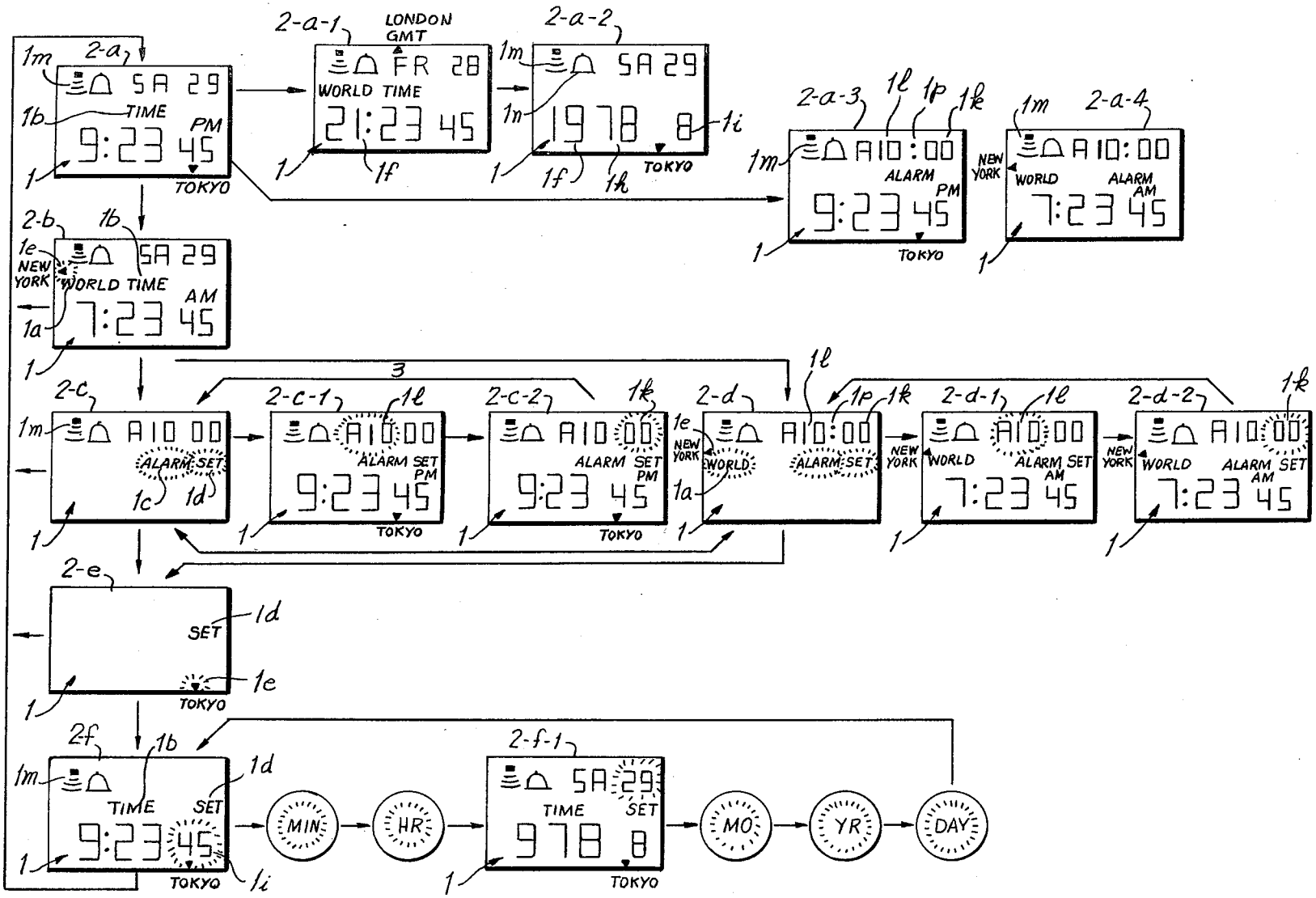
FIG. 2 is a functional diagram illustrating the effect on the visual display of the timepiece of FIG. 1 as external members are actuated.

FIG. 2 is a diagram illustrating the ways of using the watch of FIG. 1. The multifunctional watch of this embodiment of the invention has five modes. By operating the mode-changing button 2, the watch display is changed successively from a home time mode 2-*a* to a global time mode 2-*b* to an alarm-set mode 2-*c*, 2-*d* to a home-zone-set mode 2-*e* to a time-set mode 2-*f* and return to home time mode 2-*a*. The display automatically returns to the home time mode 2-*a* from any other mode when the mode-changing button 2 is continuously depressed for a period of one to 1.25 seconds. Furthermore, the watch has a jump function, that is to say, when the mode-changing button 2 is operated after operation of button 3 or 4 in the alarm-set mode, the watch returns automatically to the home time mode 2-*a*. In the modes of alarm set 2-*c*, 2-*d*, home zone set 2-*e* and time set 2-*f*, the watch automatically returns to the home time mode 2-*a* when operation of button 3 or 4 is not performed for one or two minutes. The multifunctional watch has various display states, accordingly, it is sometimes difficult to immediately understand what conditions are being displayed. However, as described above, by various means, the watch can easily be placed in the home time mode 2-*a*, which is the fundamental state of the watch. From there, the normal operating procedures will bring the display into any desired condition for observation or adjustment.

When the watch is in the home time mode 2-*a*, the mode marker means 1*b* is displaying "TIME" by illumination and thereby indicates that the watch is in the home time mode 2-*a*. Furthermore, also illuminated and displayed are the time zone mark 1*e*, hours, minutes, seconds, AM/PM, date, day of the week, the alarm mark 1*m* and time signal sound mark 1*n*. The home time mode 2-*a* of FIG. 2 illustrates that it is afternoon (PM) and 23 minutes, 45 seconds after the ninth hour on Saturday, the 29th day of the month in Tokyo. Also, the alarm and the time signal sound are set.

When the operation button 3 is pushed with the watch in the condition 2*a* as shown in FIG. 2, Greenwich mean time 2-*a*-1 is displayed on the panel 1 during the time period when the button 3 is depressed. There is a time difference between the time being displayed for Greenwich and the time displayed for Tokyo in the home time zone 2-*a*. Greenwich mean time is displayed in this condition 2-*a*-1 in the 24-hour system for convenience sake of a user who needs Greenwich mean time using the indicator markers 1*f*. However, the 24-hour system is difficult to use for the general public in everyday life. Therefore, when displaying the time of London, in a home time mode or in a global time mode, even though it is in the same time zone as Greenwich mean time, the Londom time is displayed in the 12-hour system. The display 2-*a*-1 illustrates that it is 23 minutes and 46 seconds after the 21st hour on Friday, the 28th day of the month in Greenwich mean time. Further, the alarm and the time signal sound modes are set.

Another display 2-*a* -2 is obtained by pushing the operation button 3 when the watch is in the home time state 2-*a*. The conditions 2-*a*-1 and 2-*a*-2 are displayed alternately when the operation button 3 is pushed. In the display 2-*a*-2, the display elements 1*f* and 1*h* display the year and display element 1*i* shows the month. These display elements in condition 2-*a* had indicated hours and minutes and seconds, respectively. The display 2-*a*-2 indicates that it is Saturday (SA), the 29th day of Aug. 8, 1978, in Tokyo, the same zone as the home time zone shown in home time mode 2-*a*. Also, the alarm indicator 1*m* and the time signal sound indicator 1*n* are set and illuminated.

When the display panel 1 is in the mode 2-*a* and the operation button 4 is pushed, the display shows the condition 2-*a*-3. This condition 2-*a*-3 repeats the time of the home time mode 2-*a* and indicates the time for which the alarm is set by means of the display elements 1*l*, 1*k* and 1*p*. In this display 2-*a*-3, it is illustrated that the alarm is set for the morning (A) at 10 o'clock in Tokyo.

The alarm display 2-*a*-4 is produced on the display panel 1 by the same operation of button 4 as is used to produce the display 2-*a*-3. Display 2-*a*-4 gives the alarm time in a global or world time setting, whereas the display 2-*a*-3 gives the alarm time for a home time display setting. As explained more fully hereinafter, when the alarm time is set for the home time mode, it will appear in a display 2-*a*-3 when the button 4 is operated, but if the alarm is set in a global time condition, then a display as shown in 2-*a*-4 appears when the button 4 is operated. In FIG. 2, the display 2-*a*-4 illustrates that it is 23 minutes, 45 seconds after the seventh hour in the morning in New York, and the alarm is set for the morning (A) at 10 o'clock.

Display 2-*b* is the global time mode which appears when the home time mode 2-*a* is displayed and the button 2 is depressed. Mode indication elements 1*a* and 1*b* show that the watch is displaying global time in that the words "WORLD TIME" appear on the panel 1. In this mode, the element 1*e* indicates the time zone by flickering on and off as indicated in FIG. 2 by the short radiating lines around the zone marker. The flickering indicates that the watch is in a condition where the zone marker can be moved. When the button 3 is pushed, the time zone indication element 1*e* moves toward the adjacent time zone having an advanced time, that is, a later time, and when the button 4 is pushed, the time zone indication element 1*e* moves into the adjacent time zone having an earlier time. Further, when the button 3 or 4 is pushed in and held for one to 1.25 seconds, movement of the illuminated zone indication is rapidly advanced. Display 2-*b* shows that it is 23 minutes and 45 seconds after the hour of 7 o'clock in the morning on Saturday, the 29th day of the month in New York. The watch is in the global time mode as indicated by the word "WORLD", and the alarm and the time signal sound are set for actuation.

The alarm-setting mode 2-*c* is brought into illuminated display when the display panel is in the global time mode 2-*b* and the operation button 2 is pressed. Display 2-*c* shows the alarm-setting mode which corresponds with the home time mode 2-*a*. Display elements 1*c* and 1*d* flicker the words "ALARM SET" to indicate that the watch is in the alarm-setting mode. A second alarm-setting mode 2-*d* is used for global alarm setting and is distinguished from the mode 2-*c* by the illumination and flickering of an additional word "WORLD" in the global mode 2-*d* by means of the element 1*a*. Either alarm-setting mode can be selected. The display state 2-*c* and the display state 2-*d* are alternated every time the operation button 4 is pushed. The alarm time in both modes is displayed by display elements 1*l*, 1*p* and 1*k*.

Display 2-*c* shows that the alarm is set for 10 AM. Button 3 is pushed to provide the display 2-*c*-1, which is the home alarm condition; the hour markers 1*l* flicker to indicate that the hour alarm time is in condition to be set. The present time of the home time mode is also displayed, namely, it is 23 minutes, 45 seconds after the hour of 9 PM in Tokyo. Display elements 1*c*, 1*d* indicating "ALARM SET" are already illuminated at that time, and the watch does not revert to the global alarm-set mode 2-*d* when the operation button 4 is pushed. When the button 4 is pushed and the display panel is in the state 2-*c*-1, the hour of the alarm time is changed in a positive direction by an hour every time the button 4 is actuated. In this manner, the hour of the alarm is set. Again pushing the button 3 in this state places the watch display in the mode 2-*c*-2 wherein the minute indicators 1*k* of the alarm time begin flickering to indicate that the watch is in condition where the minute for alarm actuation can be set. The minute reading 1*k* is advanced in the same manner as the hour indication is advanced, namely, by utilizing the button 4 to advance the setting by one minute for each actuation of the button. The watch returns to the state 2-*c* when the button 3 is again pushed.

When the alarm time is set, for example, for 10 AM in the alarm set modes 2-*c*, 2-*c*-1, 2-*c*-2, the alarm sound is emitted when the watch indicates 10 AM in any home time mode 2-*a*, in the display of Greenwich mean time 2-*c*-1 and in the global time mode 2-*b*. Thus, for example, a person who set the alarm for 10 o'clock in the morning using the alarm-set procedure 2-*c*, etc. would be alerted by his alarm at 10 AM in Tokyo if the watch was in the home time mode 2-*a* and home time was Tokyo. The user would also be altered at 10 AM in New York if the watch was in global time and set to indicate the New York time zone. If, continuing the example, the user flew from New York to California, where there is a three-hour time difference between those two cities, the user would be alerted at 10 AM in California if the watch was set for global time and the zone indicator was set for California.

Setting the world alarm is similar in procedure. Starting from the home time mode 2-*a*, actuation of button 2 two times will bring the display into the alarm-set condition 2-*c*. As stated above, actuation at this time of button 4 places the display in condition 2-*d*, wherein the alarm time is shown and the words "WORLD" and "ALARM SET" are displayed in a flickering condition. This indicates that the alarm can now be set and as explained more fully hereinafter a world alarm setting is to be made. In display mode 2-*d*, the zone mark 1*e* is illuminated in a flickering manner; the illustration of FIG. 2 indicates the zone marking for New York. The alarm is set for 10 AM in New York, as indicated on the display 2-*d*. Operation of the button 3 places the display in the condition 2-*d*-1, wherein the flickering of the words "WORLD" and "ALARM SET" ceases and the time of day in New York is presented, indicating that it is 23 minutes, 45 seconds after the hour of 7 AM. Also, the hour indicators 1*l* (A10) flicker to indicate that the watch is in condition for setting the hour of the alarm. As with the home alarm situation 2-*c*, etc., operation of button 4 causes the hour markings 1*l* to advance by one hour for each actuation of the button 4 until the desired hour of the alarm setting is reached. Then operation of button 3 produces the condition 2-*d*-2 on the display panel 1 and the markers 1*k* for minutes are now in a flickering condition, indicating that the minute setting for the alarm may be made at this time. Operation of button 4 advances the minutes indication by one minute for each actuation of the button 4 until the alarm time has been set. When the alarm time is set with the display panel 1 in the global-alarm-setting mode, the alarm sound is emitted when the time in that global time zone coincides with the alarm-set time. Continuing with the example presented by the illustration 2-*d*-2, when the alarm is set for 10 AM in New York, the alarm sound is emitted when the time is 10 AM in New York even though the timepiece display may be in the home time mode 2-*a* giving Tokyo time or in the global time condition 2-*b* giving the time of any time zone, including or excluding New York, which has been selected by the user. In other words, when the alarm is set in the global alarm display conditions, the alarm sounding is referenced to that set time in the time zone for which it was set regardless of the condition of the display and triggers when the alarm-set time occurs in the alarm-set global zone. However, with regard to the display of time, when the time zone is changed, for example, by an hour, the alarm-set time and the global time are also changed by an hour when the watch is adjusted for reading in the new time zone. For example, after setting the watch in the New York global zone to sound an alarm at 10 AM (2-*d*-2), the alarm-set time and the global time will be reset automatically, for example, by an hour when the Chicago zone is selected. Then the alarm-set time is 9 AM in Chicago, and the present time indicated for Chicago is 23 minutes, 45 seconds after 6 AM rather than after 7 AM as in New York.

Thus, by the described method of alarm setting which distinguishes between the normal alarm-set mode and the global alarm-set mode, various effects can be obtained in usage of the watch. For instance, a person who is making a tour around the world and desires to awake at 7 AM local time every day can accomplish this in any country or time zone merely by setting the alarm time for 7 AM in the normal alarm time set mode (2-*c*) and then wearing the watch in the global time mode, changing the position of the illuminated time zone marker 1*e* to correspond with his travel.

Moreover, for example, if a person must report to his office in New York by telephone at 10 AM every day regardless of his present location throughout the world, it is unnecessary to set the alarm time as he moves from global zone to global zone to take account of the changing time difference between his present location and New York. This is accomplished by setting the alarm for 10 AM when the timepiece is in the global alarm-set mode (2-*d*). Then the initially set alarm time for New York is never changed, and every day when it is 10 o'clock in the morning in New York, the alarm will sound.

When the watch is in the display mode 2-*c*, operation of button 2 brings mode 2-*e* to the display. Display element 1*d* is illuminated to indicate "SET" and the zone indication mark 1*e* is illuminated in a flickering manner so as to indicate that the watch is in a state where the home zone can be set. That is, it is not necessary to maintain Tokyo as in FIG. 2 as the home time zone. Any time zone may be made into the home time zone having the advantage that there are many operations which revert the display to the condition of the home time zone (2-*a*). With the watch in the home zone set mode 2-*e*, operation of the button 3 changes the indicated home zone moving in the negative time-difference direction every time the button 3 is pushed. It should be noted that not every time zone difference is an hour. The display markers 1*e* accommodate time differences of less than an hour as they occur in the sequence representing the actual time zones around the earth.

From the display mode 2-*e*, operation of the button 2 brings the watch into the condition of time set 2-*f*, where the home time is displayed along with the words "TIME SET". Display elements 1*i* flicker to indicate that the seconds may be set. Pushing the button 4, the seconds indication 1*i* is reset to 00, which will suffice if the timing accuracy is within ±30 seconds. Then, when the button 3 is pushed, the digit which can be corrected is minutes, and after that is accomplished, the procedure continues to the hours, date (2-*f*-1), month, year and then to the day of the week in a sequence every time the button 3 is pushed. Such a time-correcting method is well known in the prior art. In each operation for moving the zone, setting the alarm time and setting the time, a quick advance is provided using an 8 Hz signal when the button 3 or 4 is maintained in the pushed-in condition for one to 1.25 seconds. In such operation, the display states of the display elements are changed from a flickering-state to a steady-state illuminated condition so that the quick advance can be easily observed.

With regard to sounding of the alarm, the sounding can be stopped by pushing the button 3 or the button 4. Sounding of the alarm can be prevented in advance without revising the alarm-setting time. The alarm can be made to sound again by simultaneously pushing the button 3 and the button 4 to illuminate or not illuminate the marks 1*m* and 1*n*. When the mark 1*m* is illuminated, the alarm is set at a selected time. When the mark 1*n* is illuminated, the audible time signal is set for sounding when the alarm-set time is reached. By pushing the buttons 3 and 4 simultaneously, first the marks 1*m* and 1*n* are illuminated simultaneously, and on the next actuation of the buttons, they are both unilluminated. The next simultaneous actuation of the buttons 3 and 4 illuminates only the mark 1*m*, and a further simultaneous actuation of the buttons 3 and 4 illuminates only the mark 1*n*. Thus, the above operation can be cyclically repeated, and any combination of alarm with or without the audible alarm time signal, or no alarm setting at all, can be selected by the user. The alarm can be made to sound by way of a trial so that the user is familiar with the sound thereof. The audible alarm sounds for 20 seconds after the actual time coincides with the alarm-set time. The audible quality of the alarm sound in the first 10 seconds differ from that in the latter 10 seconds. In testing the alarm to assess the quality of the sound, both alarm sounds can be listened to in turn.

Figure 3:
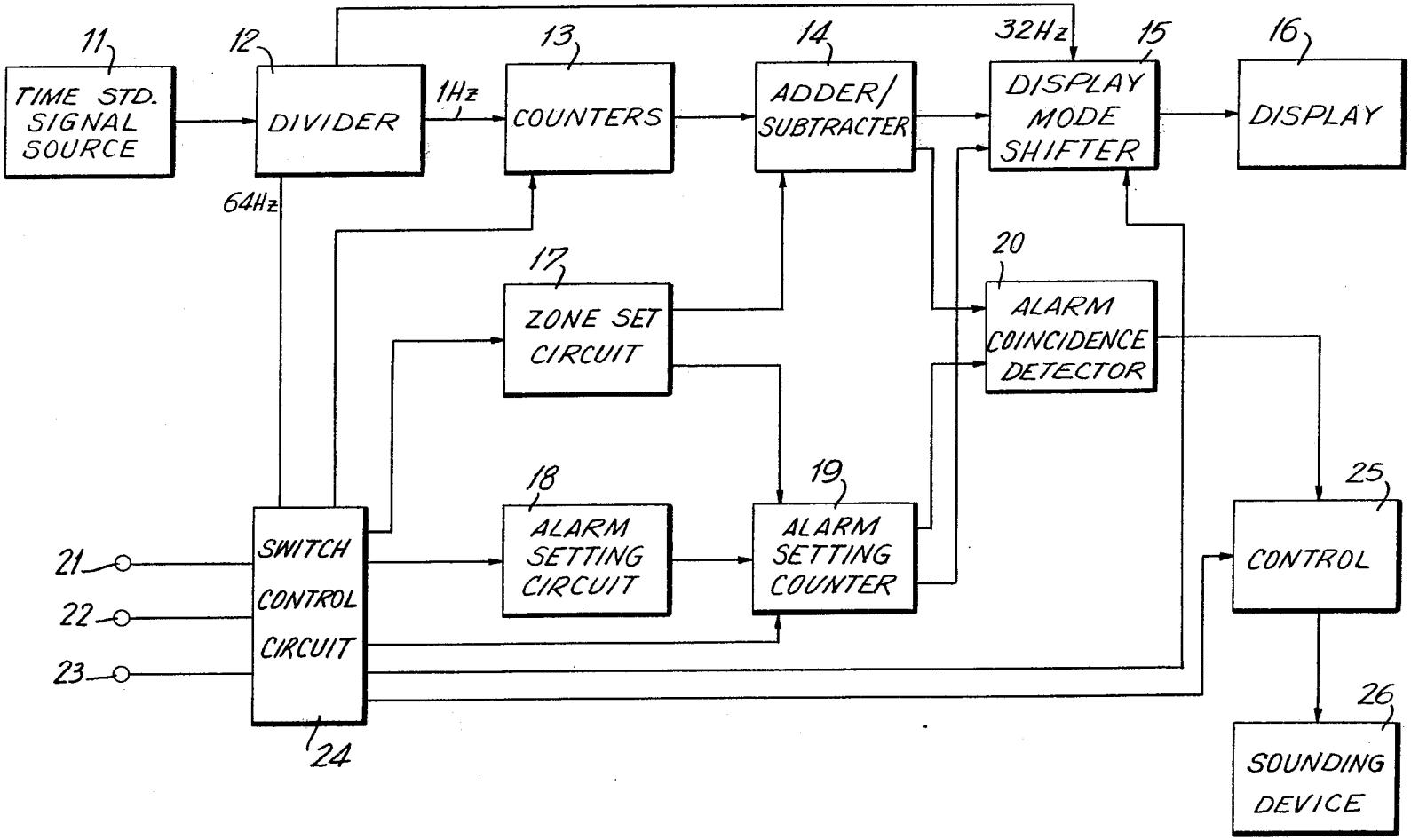
FIG. 3 is a functional block diagram of a portion of the circuitry of the watch of FIG. 1.

FIG. 3 is a functional block diagram of the electronic watch according to this invention having the world or global time function and the alarm function described above. A time standard source 11, such as a quartz crystal oscillator, outputs a high-frequency signal which is divided down in the divider circuit 12 so as to provide a 1 Hz output.

Switches 21, 22 and 23 correspond functionally to the buttons 2, 3 and 4, respectively, of FIG. 1, and their actuations provide inputs to the switch control circuit 24. The switch control circuit 24 provides signals to a display mode shifter 15 which changes over the mode of a display 16 by receiving signals of 32 Hz from the divider circuit 12. The display means 16 is, for example, a liquid crystal panel.

Counter circuits 13 include counters serving as memories of data for seconds, minutes, hours, date, month and year. An adding and subtracting circuit 14 receives signals from the counters 13 and the zone-setting circuit 17 and in response thereto adds or subtracts time by units of 30 minutes or an hour to and from the basic time data of the watch as zones are changed.

An alarm function selecting circuit 18 is actuated in response to a signal from the switch 23 by way of the control circuit 24 and selects the normal alarm-set mode 2-*c* or the global alarm-set mode 2-*d*. An alarm-setting counter 19 also receives the signal from the switch 23. While the global alarm-set mode 2-*d* is selected by the alarm select circuit 18, the alarm-set time is changed by the time difference whenever the time zone is changed by means of the zone-set circuit 17. In that way, both actual time and local time for the alarm change together for the global alarm mode.

A coincidence circuit 20 compares the present time of the watch in the adder-subtractor 14 with the set alarm time in the alarm-setting counter 19, and upon coincidence, the detector circuit 20 drives a control circuit 25 which when driven actuates a sounding device 26. The circuit 17 for adjusting the zone and the time differences can adjust for 30-minute time differences, 15-minute time differences and 45-minute time differences in addition to the 24 zones having a one-hour time difference by acting on the counter 19 and by modifying the data in the counters 13 in the adder/subtractor 14 prior to display.

As stated above, the electronic watch according to this invention is a convenient watch wherein a global time function and an alarm function are inherently combined so that they fulfill their respective functions as completely and efficiently as possible.

It will thus be seen that the objects set forth above, and those made apparent from the preceding description, are efficiently attained, and since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. An electronic watch for use in a plurality of globel time zones, comprising:

signal-generating and signal-dividing means for generating standard signals for time data;

display means for selectively displaying time data for any of said plurality of global time zones;

means for selecting any one of said plurality of time zones for display of corresponding time data;

means for setting a global alarm time for any selected one of said plurality of time zones;

alarm function means for attracting a user's attention, said alarm function means triggering when the displayed time coincides with said global-set alarm time; and means for coincidentally changing the global-set alarm time by an amount corresponding to the time difference between zones when the time zone for display is changed by operation of said means for selecting time zones, whereby said alarm function means is triggered upon the occurrence in the time zone where said alarm time is set of the global-set alarm time, regardless of the zone of the time data selected for current display.

2. An electronic watch as claimed in claim 1, and further comprising means for setting home alarm time in one selected time zone, said alarm function means being triggered whenever said display indicates time data coinciding with said home-set alarm time, whereby said alarm function means is triggered at the selected home alarm time during display of time data in any time zone of operation.

3. An electronic watch as claimed in claim 1 or 2, wherein said time zones are selected and said alarm times are set by actuation of at least one external member on said watch.

4. An electronic watch as claimed in claim 2, wherein said signal-generating and signal-dividing means also generates signals for calender data and said display shows calender data.

5. An electronic watch as claimed in claim 1 or 2, wherein said display exhibits alarm-set time in conjunction with present time data in the time zone selected for alarm setting.

6. An electronic watch as claimed in claim 1 or 2, wherein said display exhibits the selected zone.

7. An electronic watch as claimed in claim 1 or 2, and further comprising first memory means for accumulating at least hour and minute signals from said signal-generating and signal-dividing means for time display, and second memory means cooperating with said means for setting a global alarm time, said second memory means holding data of at least hours and minutes for said global alarm setting, and said means for selecting a time zone modifying the data in said alarm and timekeeping memory means corresponding to each change in said time zones selected for current display.

8. An electronic watch as claimed in claim 7, wherein said memory means are counters and the count in said counters is changed when said time zone for current display is changed.

9. An electronic watch as claimed in claim 8, wherein said time zone is changed by actuation of an external member.

10. An electronic watch as claimed in claim 7, and further comprising a coincidence detector, said detector comparing the counts in said memory means and triggering said alarm function means when said counts are equal.

11. An electronic watch as claimed in claim 8, wherein said alarm function means when triggered outputs an audible sound.

12. An electronic watch as claimed in claim 2, and further comprising circuit means for selectively enabling said alarm function means to be set in either the global mode or home time mode.

* * * * *